US005619764A

United States Patent [19]

Lopau

[11] Patent Number: 5,619,764

[45] Date of Patent: Apr. 15, 1997

[54] MATTRESS FOR DECUBITUS PROPHYLAXIS

[76] Inventor: Helmut Lopau, Buchenweg 6, D-25492 Heist, Germany

[21] Appl. No.: 630,627

[22] Filed: Apr. 10, 1996

[30] Foreign Application Priority Data

May 6, 1995 [DE] Germany ..... 195 16 744.9

[51] Int. Cl.[6] ..... A61G 7/00

[52] U.S. Cl. ..... 5/713; 5/715; 5/723; 5/933

[58] Field of Search ..... 5/689, 706, 710, 5/711, 712, 713, 715, 723, 933

[56] References Cited

U.S. PATENT DOCUMENTS

| | | | |
|---|---|---|---|
| 2,731,652 | 1/1956 | Bishop | 5/710 |
| 4,962,553 | 10/1990 | Marquis | 5/723 X |
| 5,109,560 | 5/1992 | Uetake | 5/713 |
| 5,109,561 | 5/1992 | Schild | 5/713 |
| 5,117,518 | 6/1992 | Schild | 5/713 |
| 5,133,096 | 7/1992 | Neumann | 5/723 X |
| 5,142,720 | 9/1992 | Kelso et al. | 5/715 X |
| 5,394,577 | 3/1995 | James et al. | 5/713 |
| 5,564,142 | 10/1996 | Liu | 5/710 X |

FOREIGN PATENT DOCUMENTS

| | | |
|---|---|---|
| 0094594 | 11/1983 | European Pat. Off. . |
| 0217878B1 | 4/1987 | European Pat. Off. . |
| 8335794 | 5/1984 | Germany . |
| 8435873 | 3/1985 | Germany . |
| 9214351 | 1/1993 | Germany . |

*Primary Examiner*—Michael F. Trettel
*Attorney, Agent, or Firm*—Roylance, Abrams Berdo & Goodman LLP

[57] ABSTRACT

A mattress for recumbent prophylaxis, which has a plurality of support elements in sequence relative to one another, with each support element having at least two air-inflatable double chambers or inflatable members connected together by a fillet. Each double chamber or inflatable member has a bottom hollow body connected to an opposite, top hollow body by a common partition wall with at least one opening. The support elements are detachably connectable with one another and are arranged transverse to the longitudinal axis of the mattress. Each of the bottom hollow bodies are connectable by a short connecting piece through hose connections to an air pump assembly in such a manner that the different chamber systems which are not communicating with one another can be acted upon with air alternately.

15 Claims, 5 Drawing Sheets

MATTRESS FOR DECUBITUS PROPHYLAXIS

FIELD OF THE INVENTION

The invention generally relates to a mattress composed of a plurality of inflatable support elements in row sequence for recumbent prophylaxis. More specifically, this invention relates to a mattress in which each support element includes at least two rows of hollow, inflatable, lamellar bodies bound together by a fillet. The support elements can be detachably connected with one another and are arranged transverse to the longitudinal axis of the mattress. Each hollow body is connected by a tubing system of hoses to an air pump assembly, so that each row of hollow bodies forms a system of chambers which can be acted upon with air.

BACKGROUND OF THE INVENTION

Mattresses for recumbent prophylaxis are designed to protect persons who are bed-ridden for a long period of time (recumbent) so as to minimize the possibility of them from developing bed sores by means of certain mechanisms which are specific to these mattresses. To accomplish this, it is particularly important to be able to guarantee a sufficiently long relief of tissue zones, which are being subjected to pressure, in recurrent time cycles to be able to preclude the formation of grievous pressure abscesses.

One example of a pneumatic turning mattress is disclosed in European A-0 094 594 which is designed to relieve pressure-compromised tissue zones in the case of patients who are recumbent. This mattress consists of two air chamber systems arranged adjacent to one another, but not communicating with one another. The two air chamber systems are connected with one another by a holding fillet. Each air chamber system incorporates a plurality of lamellar hollow bodies of polyethylene foil arranged adjacent to one another, in which the hollow bodies of each air chamber system are connected with one another by air passage slots. The two air chamber systems can be inflated alternately and thereafter the air can be released again. Thus, a patient lying on the mattress can be rotated passively around the patient's longitudinal axis from one side to the other side by alternately inflating and deflating the two air chamber systems. However such a mattress is not adaptable to individual requirements, which would be different for each patient, since at any moment only the entire air chamber system would be filled with air or can be emptied of air. Thus, partial areas of the air chamber system cannot be acted upon separately from the entire air chamber system.

Another pneumatic turning mattress is disclosed in German Utility Patent G 84 35 873.4 which consists of two air chamber systems not communicating with one another. Each air chamber system of this mattress includes a plurality of lamellar elements running transverse to the longitudinal axis of the mattress, communicating with one another, and each two adjacent lamellar elements are connected with one another by a fillet. The lamellar elements are connected through a hose system with a pump assembly, through which the elements can be acted upon with air. Suitably constructed press-fasteners have been suggested as means for connection of the elements with one another, by which the length of the mattress can be adapted to the individual structural conditions or situations.

A mattress composed of mat units is disclosed in German Utility Patent G 83 35 794. Each of the mat units of this mattress consists of an airtight bellows. The airtight bellows is provided with an air feed conduit and a valve for control of the air volume pumped into the bellows at one end, while an air discharge conduit with a valve controls the air volume flowing out of the bellows is provided at the other end of the bellows. The air volume found within the bellows is detected through a sensing device, such as a photoelectric sensor. On the surface of the bellows is a sensor for determination of the contact of the bellows with a body lying on it.

These prior mattresses or mattress-like arrangements have numerous drawbacks. For example, it has been shown that these prior art turning mattresses are very hard when they are inflated, so that the patient lying recumbent on such a mattress feels that it is uncomfortable after a relatively short time. In addition, the lamellar elements of some prior art mattresses are inclined at different points to form folds after being inflated, which leads to a remarkable negative effect on the patient's comfort. The shape of the prior art's lamellar elements also leads easily to undesirable formation of riffles or grooves, caused by the pressure of the body lying on the mattress. Therefore the body of a patient lying on the mattress frequently cannot be supported and provided relief to the degree required at the points required for support, for example on the shoulders. The prior art mattresses, which are composed of airtight bellows, are extraordinarily costly in construction, and thus are very expensive to manufacture and maintain.

Thus, there exists a need for a mattress which is relatively simple in construction and which is relatively inexpensive to manufacture. This invention addresses these needs in the prior art as well as other needs or problems that exist in the prior art.

SUMMARY OF THE INVENTION

One object of the present invention is to make available a mattress for decubitus or recumbent prophylaxis which can be manufactured in relatively simple construction.

Another object of the present invention is to provide a mattress for recumbent prophylaxis which can be manufactured in a cost-effective manner.

Another object of the present invention is to provide a mattress which exhibits practically no disrupting or disturbing deep riffles or grooves on the surface of the mattress when it is in inflated state and when the pressure is released.

Still another object of the present invention is to provide a mattress which offers improved patient comfort, which is individually adaptable to any body size as well as any body weight and which is easily operated.

Yet another object of the present invention is to provide a mattress according to the invention for recumbent prophylaxis, that greatly improves on prior pneumatic turning mattresses.

The foregoing object can be attained by providing a mattress constructed of a plurality of support elements arranged together in rows. Each of these support elements includes at least two air-inflatable, lamellar, hollow bodies connected with one another by a fillet. The support elements are detachably connected with one another and arranged transverse to the longitudinal axis of the mattress. Each hollow body in a support element is provided with a short connecting piece for connecting the hollow body through a hose system to an air pump assembly. Each of the hollow bodies of a plurality of support elements are arranged in sequence one behind the other and are connected through the hose system with other hollow bodies of the sequence. The hollow bodies which are connected together form an air-inflatable chamber system. The support elements have at least two hollow bodies connected with one another by a fillet so as to format least two rows of hollow bodies arranged one behind the other. Each row of hollow bodies forms at least one chamber system which is to be acted upon with air, and which does not communicate with the other chamber system or systems. When more than two sequences of hollow bodies are communicating with one another, these hollow bodies are to be connected with one another and with the air pump assembly so that at least two air-inflated chamber systems are formed not communicating with one another.

So that the objects of the invention can be attained to satisfaction, the invention provides that the hollow bodies of a support element in the form of double chambers or inflatable members are configured and connected with one another by a fillet. Each support element incorporates at least two double chambers or inflatable members, and in turn each two adjacent double chambers or inflatable members of the same support element are connected with one another by a fillet. Each double chamber or inflatable member includes a bottom hollow body and a top hollow body lying over the bottom one, which is connected with the bottom hollow body by a common partition with at least one opening. In turn, two adjacent bottom hollow bodies of the same support element are connected with one another on the interface side by a fillet. On the other hand, the corresponding top hollow bodies with adjacent sides are not connected with one another. The fillets of the plurality of support elements in sequence one after the other are arranged in rows parallel to the longitudinal axis of the mattress. Each of the bottom hollow bodies can be connected with other bottom hollow bodies and also with the air pump assembly through a short connecting piece with the aid of hose connections. This results in a mattress having at least two different chamber systems which are not communicating with one another, and which can be inflated with air alternately.

As a result of the double chamber or inflatable member construction according to the invention, in which the two chambers are connected through one or more openings in the common partition wall, the chamber volume is considerably increased in comparison to known pneumatic turning mattresses. Thus, a person lying on the mattress of the present invention can be lifted to a certain level by inflation of the mattress with air having a notably lower level of positive pressure than with the traditional turning mattresses. The air pump assemblies used for this purpose are therefore charged to a lesser degree.

Also, by use of double chambers or inflatable members according to the invention the recumbent patient's comfort level is considerably enhanced, since improved support of certain body parts is possible with the double chambers or inflatable members, without having the patient who is lying on it feeling as though it is too hard or too rough. With the air pump assembly, the air pressure in the double chambers or inflatable members can be adjusted individually and adapted to the body weight of the person lying on the mattress. Disturbing fold or groove formation is avoided entirely or almost entirely by the suggested construction of the individual support elements, especially with the preferred constructions of the mattress according to the invention described hereinafter.

The individual support elements are detachably connected with one another by suitable connecting means, preferably by press-fastener connections. Thus, individual support elements are coupled together until the desired size of the mattress has been reached. In this manner, the size of the mattress can be adapted individually to the requirements of the person.

Generally, the mattress is provided with a protective covering of suitable material, for instance of polyurethane rubbing or massaging fabric, which must be washable and sterilizable. Furthermore a layer of foam material can be laid out on top of the mattress to cover the plurality of support elements, which together with the mattress is surrounded by the covering. In this case, care is to be taken that the dimensions of the covering are adapted to the height of the inflatable hollow bodies.

Other objects and salient features of the present invention will become apparent to those skilled in the art from this disclosure. Certain preferred embodiments of the invention are described hereinafter with respect to the attached drawings which form a part of this disclosure.

BRIEF DESCRIPTION OF THE DRAWINGS

Referring to the drawings which form part of this original disclosure.

DETAILED DESCRIPTION OF THE PREFERRED EMBODIMENTS

Figure 1:
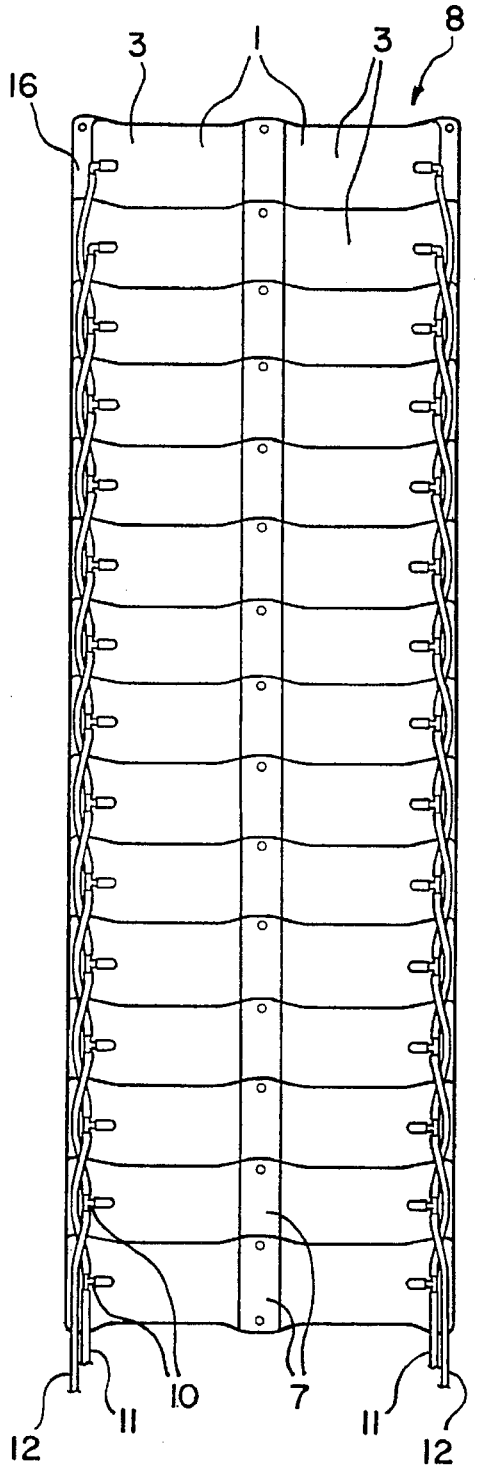
FIG. 1 is a diagrammatic bottom plan view of a mattress according to the present invention with the air pump assembly not shown.
Figure 2:
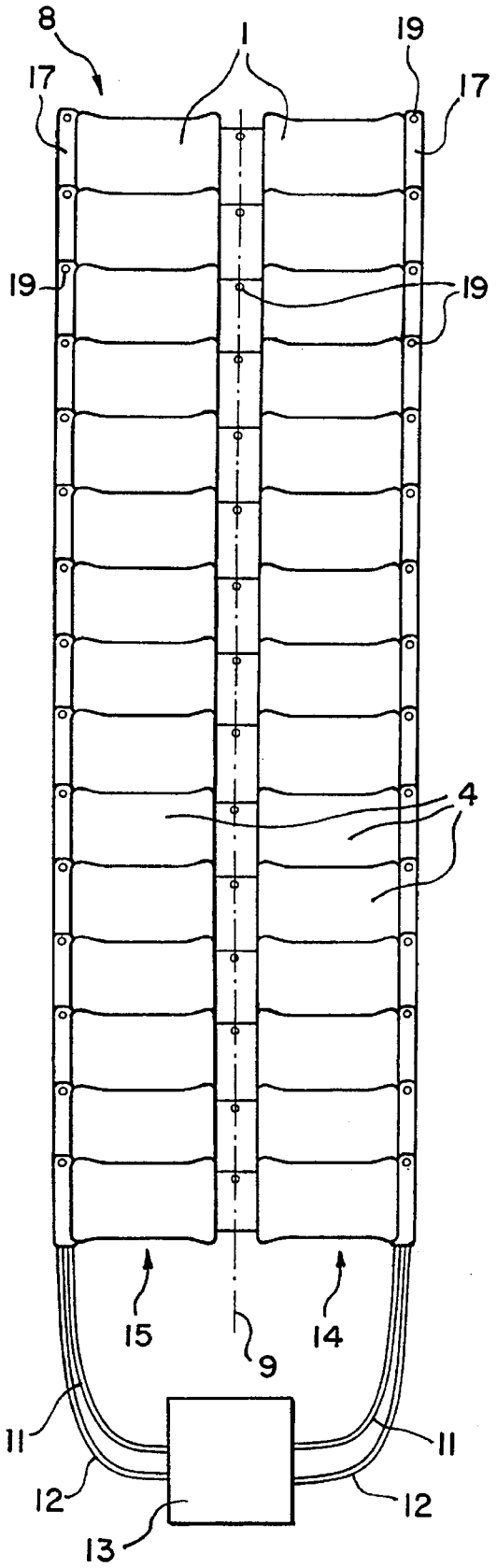
FIG. 2 is a diagrammatic top plan view of the mattress as illustrated in FIG. 1 together with the air pump assembly.

The mattress 8 in accordance with the present invention is diagrammatically illustrated in FIGS. 1 and 2. Mattress 8 includes a plurality of inflatable support elements 1 arranged in a row to form an elongated inflatable mattress which can be adjusted to meet the individual patients needs. Preferably, each support element 1 has a pair of double chambers or inflatable members 2 coupled together by a fillet or flexible connecting member 7. In particular, fillet 7 of each support element is positioned between its pair of double chambers or inflatable members 2. Each of the double chambers or inflatable members 2 includes a bottom hollow body 3 and a top hollow body 4, of which in FIG. 1 only the bottom hollow bodies 3 are shown and in FIG. 2 only the top hollow bodies 4 are shown.

Preferably, the individual support elements 1 are detachably connected to one another in a conventional manner as illustrated in FIGS. 1 and 2 via fasteners 19. In the preferred embodiment, press-fasteners or snaps 19 are used to connect adjacent support elements 1 together. The support elements 1 are arranged transverse to the longitudinal axis 9 of mattress 8.

Each bottom hollow body 3 of double chamber or inflatable member 2 is provided with a short connecting piece or tube 10, which is connected via tubes 11 and 12 to an air pump assembly 13. In particular, each of the support elements 1 with its double chamber or inflatable member 2 can be fluidly connected together by a tubing system having hose connections and tubes 11 and 12 extending between tubes 10 and air pump assembly 13 as shown diagrammatically in FIG. 2.

As can be seen in FIGS. 1 and 2, two rows of double chambers or inflatable members 2 are formed with one inflatable member of each row located behind the other when support elements 1 are coupled together. Preferably, the rows of double chambers or inflatable members 2 are not in fluid communication with each other. In other words, a first chamber system 14 is formed on the right side of longitudinal axis 9 of mattress 8 by a first row of inflatable members, and a second chamber system 15 is formed on the left side of longitudinal axis 9 of mattress 8 by a second row of inflatable members. However, the double chambers or inflatable members 2 of the first chamber system 14 can be interconnected, while the double chambers or inflatable members 2 of the second chamber system 15 can be interconnected.

Suitable arrangements and connections of hose connections and tubes 11 and 12 can be used together with controllable valves (not shown in the drawings) so that, for instance, only the even-numbered or odd-numbered double chambers or inflatable members 2 of one or both rows can communicate with one another, while first and second chamber systems 14 and 15 are formed not communicating with one another.

As seen in FIGS. 1 and 2, the first chamber system 14 is represented as being made up of double chambers or inflatable members 2 (only bottom hollow bodies 4 are seen in FIG. 1 and top hollow bodies 4 are seen in FIG. 2) arranged in sequence one behind the other to the right of longitudinal axis 9 of mattress 8, and the second chamber system 15 is likewise made up of double chambers or inflatable members 2 arranged in sequence one behind the other to the left of longitudinal axis 9 of mattress 8.

In this case, the hose connections and tubes 11 and 12 are connected in such a manner that all double chambers or inflatable members 2 on the left side and all double chambers or inflatable members 2 on the right side of longitudinal axis 9 of mattress 8 are in connection with air pump assembly 13. In particular, all odd-numbered double chambers or inflatable members 2 of both chamber systems 14 and 15 are connected together within their row via hose connections and tubes 11 so as to be inflated and deflated together via air pump assembly 13. Likewise, all even-numbered double chambers or inflatable members 2 of both chamber systems 14 and 15 are connected together within their row via hose connections and tubes 12 so as to be inflated and deflated together via air pump assembly 13. However, the double chambers or inflatable members 2 of chamber system 14 are not communicating with the double chambers or inflatable members 2 of chamber system 15. Accordingly, the chamber systems 14 and 15, which are not communicating with one another, can be alternately and independently inflated and deflated with air for turning or rotating a patient on mattress 8.

Figure 3:
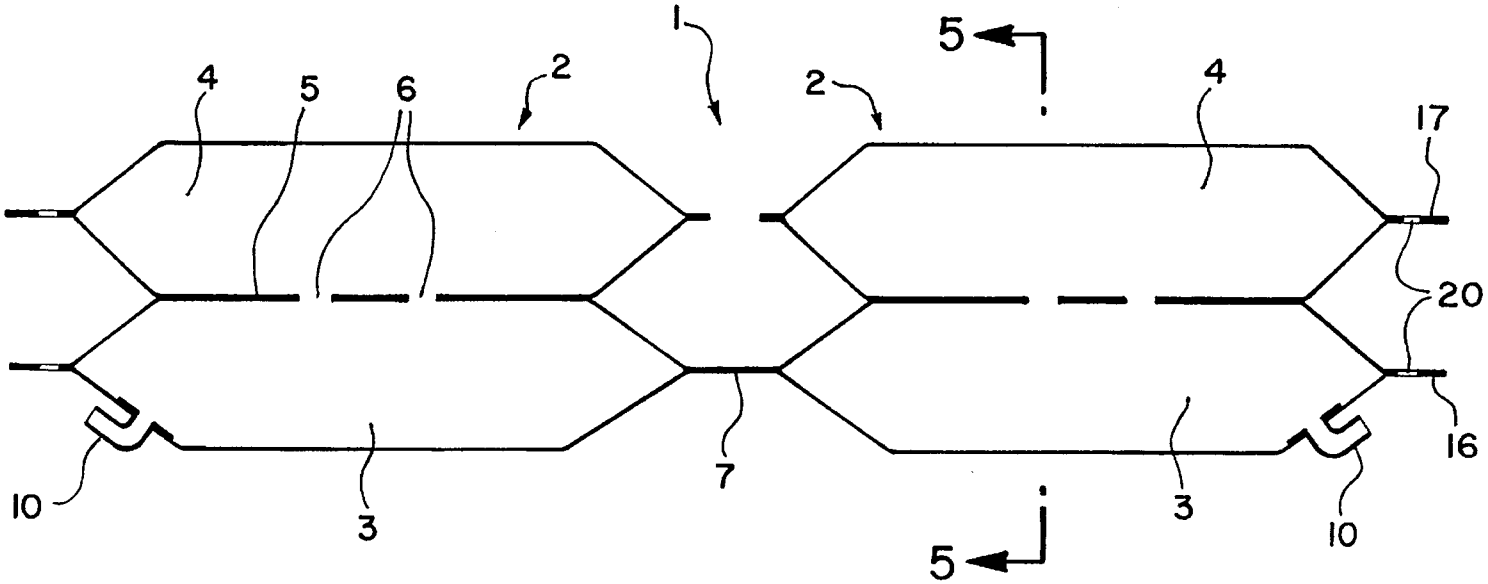
FIG. 3 is a diagrammatic longitudinal cross-section through a support element having two inflated double chambers or inflatable members.
Figure 4:
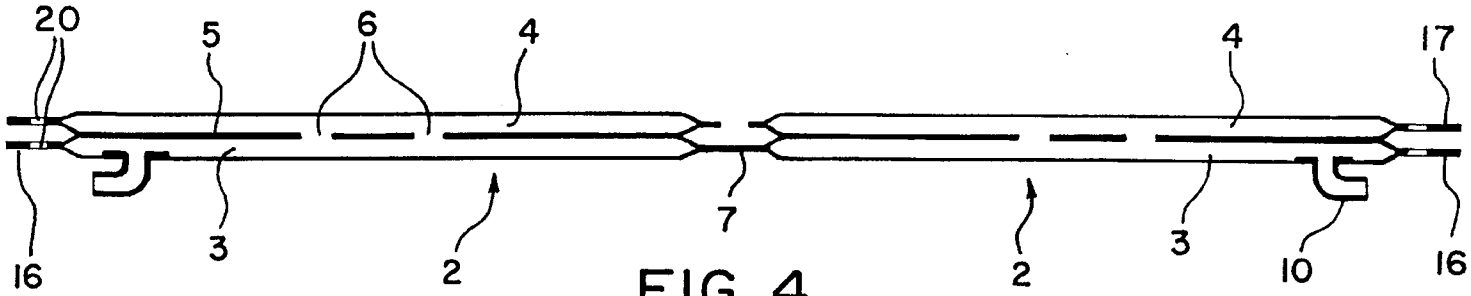
FIG. 4 is a diagrammatic longitudinal cross-section through the support element illustrated in FIG. 3 but with two emptied double chambers or inflatable members.

As particularly seen in FIGS. 3 and 4, each support element 1 has a double chamber or inflatable member 2 on each side of a fillet 7, with each double chamber or inflatable member 2 including a bottom hollow body 3 fluidly connected to a top hollow body 4. In particular, bottom hollow body 3 and top hollow body 4 are joined by a common partition wall 5 with at least one opening 6 therein to allow air to pass between bottom and top bodies 3 and 4.

Adjacent bottom hollow bodies 3 of a support element 1 are mutually connected with one another by fillet or connecting member 7. On the other hand, the corresponding adjacent sides of top hollow bodies 4 of support element 1 are not connected together. As shown in FIGS. 1 and 2, fillets 7 of the plurality of support elements 1 are arranged in sequential rows relative to one another along longitudinal axis 9 of mattress 8. In other words, as seen in FIGS. 1 and 2, the alignment of fillet 7 coincides with the position of longitudinal axis 9.

FIG. 1 shows that each of the bottom hollow bodies 3 can be connected by a short connecting piece or tube 10 to hose connections and tubes 11 and 12 which in turn is fluidly coupled to the air pump assembly 13 (see FIG. 2). The separate chamber systems 14 and 15 which are not communicating with one another can be acted upon by air from air pump assembly 13 through a suitable hose or tubing system comprising hose connections and tubes 11 and 12. For instance, the hose connections and tubes 11 and 12 as shown in FIG. 1 can simultaneously or alternately supply air to hollow bodies 3 and 4 via air pump assembly 13 or in any other desired manner.

Suitable pump assemblies, such as air pump assembly 13, are commercially available, and thus will not be discussed or illustrated in detail herein. For instance, pump assembly 13 can be provided with electronic controls and air manifolds to regulate the desired air pressure and time cycles for maintenance of a certain work setting of mattress 8.

In one embodiment of the present invention, not particularly seen in the drawings, the hose connections and tubes 11 and 12 are connected with each double chambers or inflatable members 2 of each support element 1 such that each double chamber or inflatable member 2 of support element 1 is part of a different chamber system which does not communicate with any other chamber system or systems. This would allow the double chamber or inflatable member 2 of each support element 1 to be independently and separately inflated and deflated with air to achieve the desired results. For example, a single tube and hose connection can be coupled between each connecting tube 10 of each double chamber or inflatable member 2 and air pump assembly 13. Accordingly, in a mattress 8 constructed of fifteen support elements 1 and thirty double chambers or inflatable members 2 as seen in FIG. 1, thirty tubes would be used to interconnect air pump assembly 13 to double chambers or inflatable members 2, with one tube extending from air pump assembly 13 to each double chamber or inflatable member 2.

In another embodiment of the present invention, the two hose connections 11 to the right and left of longitudinal axis 9 of mattress 8, as seen from above, can be attached to double chambers or inflatable members 2 such that the two double chambers or inflatable members 2 of each of the odd-numbered support elements 1 can be simultaneously inflated for supporting with air until they reach a predetermined air pressure to the weight of the patient lying thereon, while the air is pumped out of the double chambers or inflatable members 2 of each of the even-numbered support elements 1 arranged to the left of the longitudinal axis.

The work settings of mattress 8 can also be controlled by the air pump assembly 13 so that hose connections and tubes 11 connected to the left of longitudinal axis 9, as seen from above, fill the double chambers or inflatable members 2 of each of the odd-numbered support elements 1 with air, while the hose connections and tubes 11 connected to the right of longitudinal axis 9 empties the double chambers or inflatable members 2 of each of the odd-numbered support elements 1 of air. In an analogous manner, the two hose connections and tubes 12 are connected to double chambers or inflatable members 2 of each of the even-numbered support elements 1 on the right and left sides of longitudinal axis 9 of mattress 8 so that they can be controlled together or separately from one another.

In this manner, different possibilities are obtained for filling the individual double chambers or inflatable members 2 of the odd-numbered and even-numbered support elements 1 with air and emptying them of air, whereupon a number of alternating work settings of mattress 8 according to preselectable time intervals, by which a timed cyclical pressure release of tissue zones of a patient which are being subjected to pressure are possible and can be carried out at certain time intervals.

The very different work settings of mattress 8, which are adjustable according to the invention, allow pressure release of the tissue zones of a patient which are being subjected to pressure both with a patient lying recumbent and also by passive rotation of the patient around the patient's longitudinal axis in either or both directions. Some of the different work settings of mattress 8 according to the invention are represented in FIGS. 8*a* to 8*h*. The two chamber systems 14 and 15 of the mattress 8 as illustrated in FIGS. 8*a* to 8*h* are preferably not communicating with one another.

Figures 8A, 8B, 8C, 8D:
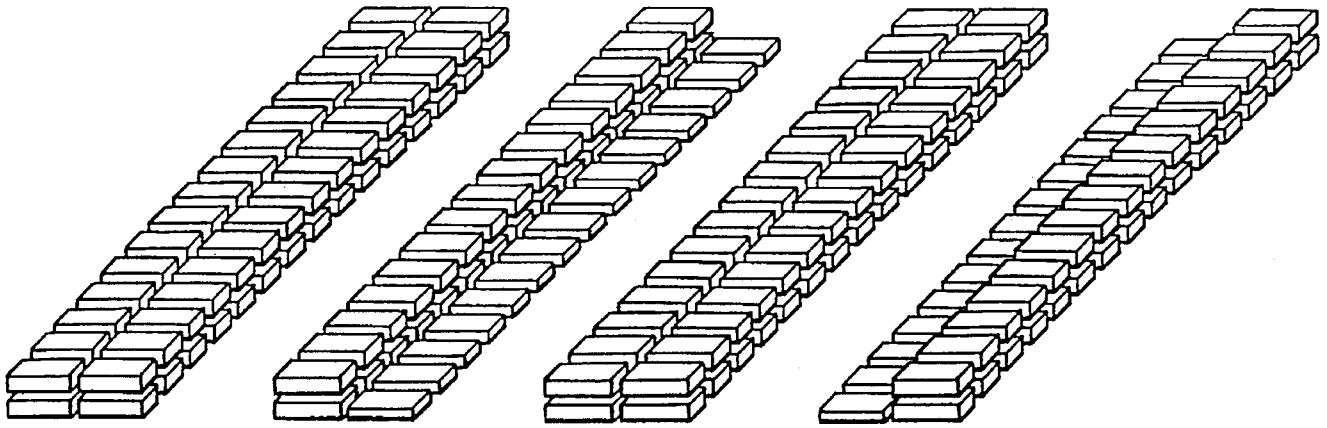
FIGS. 8*a*–8*h* are diagrammatic perspective representations of a mattress according to the present invention in various work settings.

FIG. 8*a* shows the mattress in its normal position with all double chambers or inflatable members 2 of both chamber systems 14 and 15 being completely inflated. In order to rotate a recumbent patient passively on mattress 8 about the patient's longitudinal axis to the right or left, the air is first pumped entirely out of the double chambers or inflatable members 2, which are arranged to either the right (FIG. 8*b*) or left (FIG. 8*d*) of longitudinal axis 9 of mattress 8, while the double chambers or inflatable members 2 of the other side of mattress 8 remain in inflated state. The cyclical sequence for the work settings of mattress 8 and for modification of the position of a patient from lying recumbent on the back over to the left side position, or from recumbent position on the back into transition to the right side position, is represented in FIGS. 8*a* to 8*d*, whereby it is assumed that the head of the patient lies at the top edge of each image.

Another advantageous use of mattress 8 according to the invention is shown in FIGS. 8*e* to 8*h*. In the original position (FIG. 8*e*), all of the double chambers or inflatable members 2 of support elements 1 forming mattress 8 are inflated with air until a preselected air pressure has been reached, so that a person can lie comfortably in recumbent position on the mattress 8. In order to be able in certain time cycles to relieve tissue zones of the patient, which are subject to pressure, as shown diagrammatically for instance in FIG. 8*f*, the air is pumped out of all double chambers or inflatable members 2 of odd-numbered support elements 1. In other words, the first, third, fifth and so forth support elements 1 are emptied or deflated. This causes double chambers or inflatable members 2 of these odd-numbered support elements 1 to be lowered, while double chambers or inflatable members 2 of the even-numbered support elements 1 remain inflated. Thus, the patient is completely supported by the even-numbered support elements engaging the body.

Figures 8E, 8F, 8G, 8H:
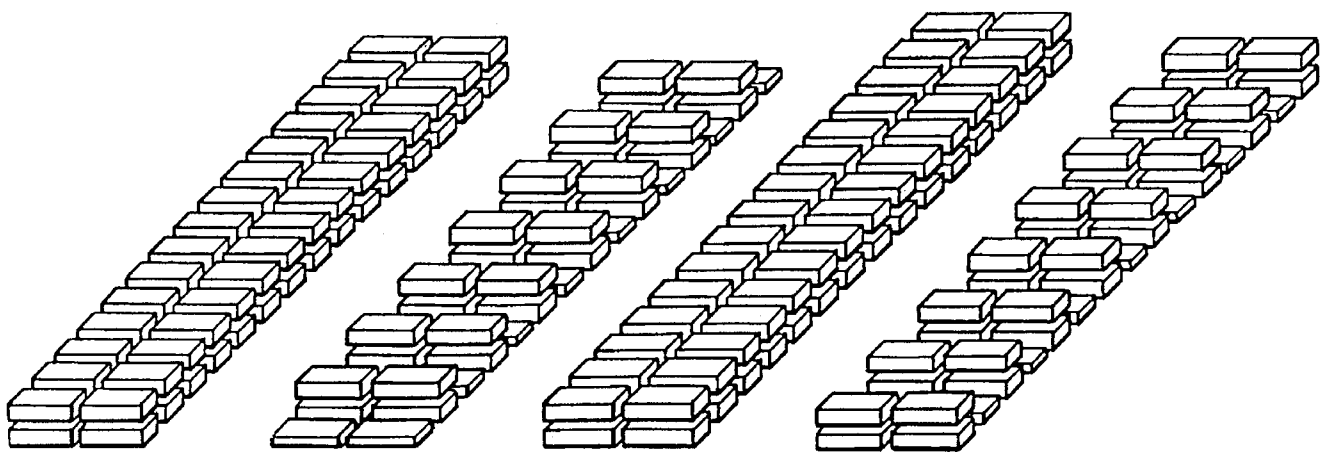

After the desired time interval has run out, the empty double chambers or inflatable members 2 of odd-numbered support elements 1 are again reinflated with air until the desired air pressure is reached in these chambers 2. Thus, the normal position of mattress 8 is obtained again as shown in FIG. 8*g*, which is identical with the original position shown in FIG. 8*e*.

In order to be able to relieve the tissue zones subjected to pressure which until this time have not been relieved, the air is now pumped out of double chambers or inflatable members 2 of even-numbered support elements 1. In other words, the second, fourth, sixth and so forth support elements 1 are emptied or deflated. Thus, the work setting of mattress 8 as shown in FIG. 8*h* is attained. After the set time interval has run out, the air-emptied double chambers or inflatable members 2 of the even-numbered support elements are reinflated, until the original setting of mattress 8 as shown in FIG. 8*e* is attained again, with all double chambers or inflatable members of both chamber systems 14 and 15 completely inflated.

Now, the cycle of the work settings of mattress 8 can be repeated again from the start to finish as seen in FIGS. 8*e* to 8*h*. Ample pressure relief of the tangent tissue zones is attained as a result of this sequence of work settings of mattress 8, without the patient necessarily being moved, which is particularly advantageous with seriously ill patients.

Basically, a support element 1 can incorporate a plurality of double chambers or inflatable members 2 which are connected with one another through the relevant bottom hollow bodies 3 by fillet 7. A symmetrical arrangement is preferred in order to be able to arrange the middle fillets 7 associated with a plurality of support elements 1 relative to longitudinal axis 9 of mattress 8, and thus improve the comfort of the bed-ridden patient, so that generally each support element 1 has an even number of double chambers or inflatable members 2, for instance four double chambers or inflatable members.

In the preferred embodiment of the invention, the individual support elements 1 are detachably connectable with one another on the interface side outside ends of the bottom hollow bodies 3 through butt straps 16 by fasteners such as press-fasteners or snaps 19 which fit in openings 20 of butt straps 16. Alternatively, the individual support elements 1 can be detachably connected with one another at the outside ends of top hollow bodies 4 by butt straps 17 by press-fasteners or snaps 19 located in openings 20 of butt straps 16.

As shown particularly in FIGS. 3 and 4, partition wall 5 preferably has two openings 6, through which top hollow body 4 is aligned in connection with bottom hollow body 3. Of course, more or less than two openings 6 can be provided in partition wall 5, insofar as the stability of partition wall 5 is not negatively influenced.

Figure 5:
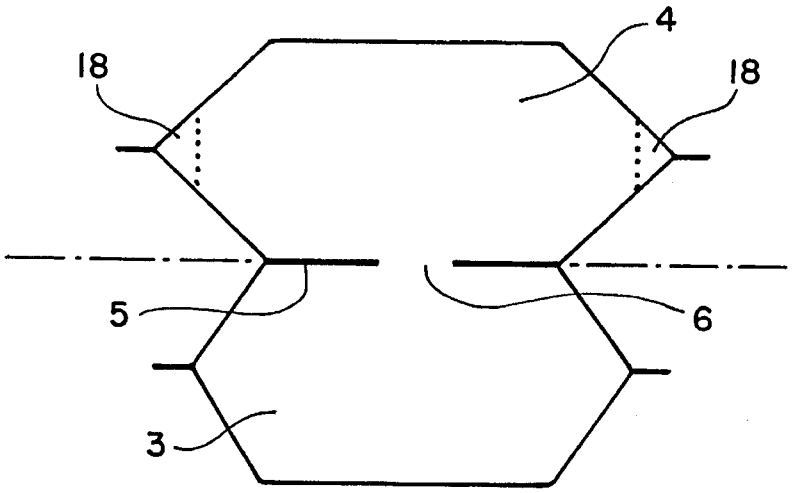
FIG. 5 is a diagrammatic transverse cross-section through a double chamber or inflatable member as illustrated in FIG. 3 but along section line 5—5 of FIG. 3.

In order to further improve the recumbent comfort of the bed-ridden patient on mattress 8 according to the invention, in another preferred embodiment as shown in FIG. 5, top hollow body 4 of double chamber or inflatable member 2 has a greater volume than bottom hollow body 3 and on its two longitudinal sides has projecting lengths 18 projecting outward in inflated state over the longitudinal sides of bottom hollow body 3. In other words, top hollow bodies 4 are of such dimensions that projecting lengths 18 overlap the edges of two adjacent top hollow bodies 4. In this manner the transverse riffles or grooves configured at an oblique angle between two double chambers or inflatable members 2 adjacent to one another along their longitudinal sides in inflated state can be covered over for the most part by overlapping projecting lengths 18, so that the surface of mattress 8 is almost flat in the areas of their double chambers or inflatable members 2 adjacent to one another along their longitudinal sides when they are in inflated state.

Figure 6:
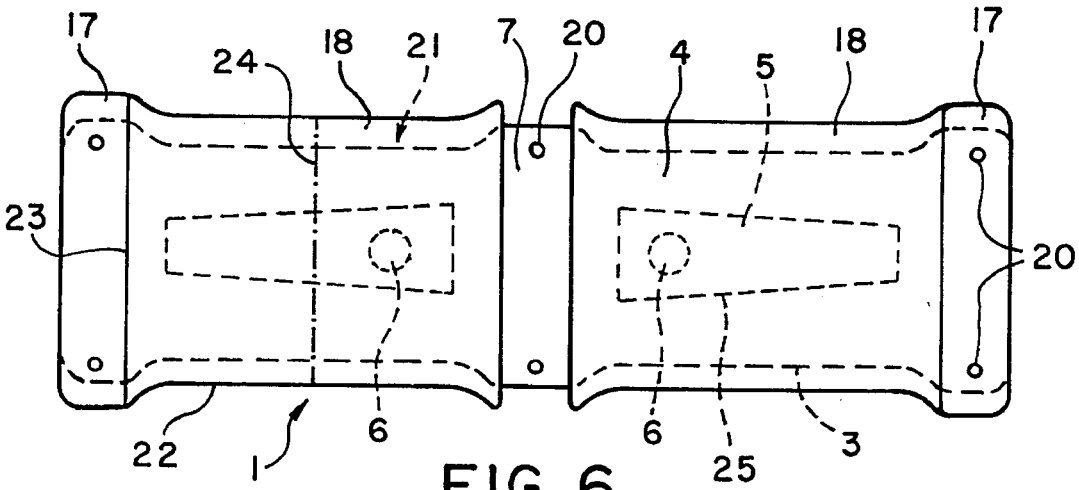
FIG. 6 is a top plan view of a construction of a support element with two double chambers or inflatable members.
Figure 7:
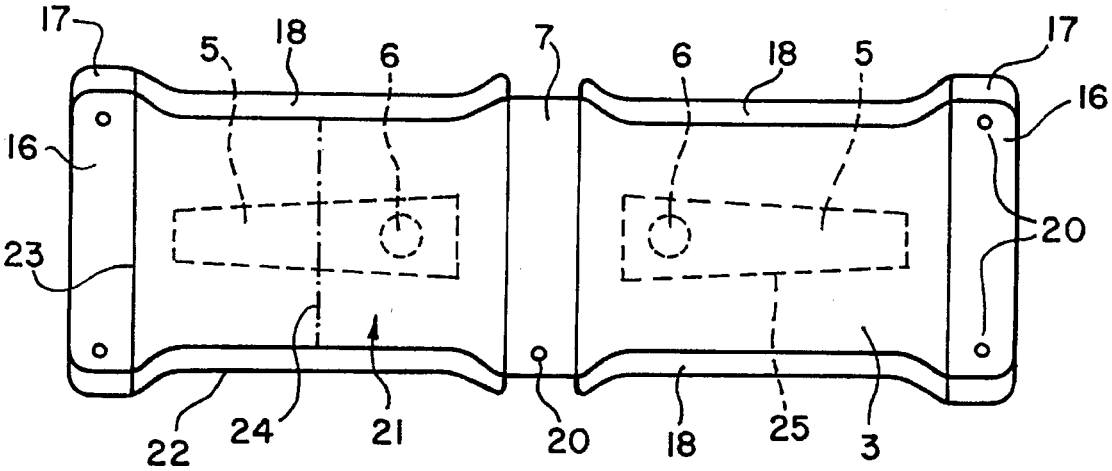
FIG. 7 is a plan view from below of the construction of a support element illustrated in FIG. 6.

In order to attain as nearly as possible a fold-free surface of inflated double chambers or inflatable members 2, in one especially preferred embodiment of the invention shown in FIGS. 6 and 7, bottom hollow bodies 3 and/or top hollow bodies 4 are present in flat, not inflated state in the form of an extended rectangle 21, of which the ends of opposite facing longitudinal sides 22 run slightly in a curve outward, so that the transverse sides 23 arranged symmetrical to transverse axis 24 of rectangle 21 are longer than transverse axis 24.

As shown in FIG. 6, bottom hollow body 3 preferably has butt strap 16 on the outer transverse side 23 and fillet 7 on the inner transverse side 23 which interconnects directly on the relevant transverse side the next adjacent hollow body 3 of the same support element 1.

In the embodiment shown in FIG. 6, the casing of the top hollow body 4 has a butt strap 17 directly connected to its outer transverse side 23. Furthermore, butt straps 16, 17 and fillet 7 have openings 20 to receive press-fastener connections 19, as is shown in FIGS. 1, 2, 6 and 7.

The two hollow bodies 3 and 4 forming each double chambers or inflatable members 2 can advantageously be welded together. If they are welded, common partition wall 5 has a weld seam 25, generally of rectangular shape as seen in FIGS. 6 and 7. In one preferred embodiment, weld seam 25 is trapezoidal, and the broader side of weld seam 25, as shown in FIGS. 6 and 7, is arranged on the side of partition wall 5 closer to fillet 7. Thus, double chamber or inflatable member 2 in its inflated state is somewhat deformed in the direction of fillet 7, so that support element 1 has a slight V-shaped depression inclined toward the fillet.

Figure 9:
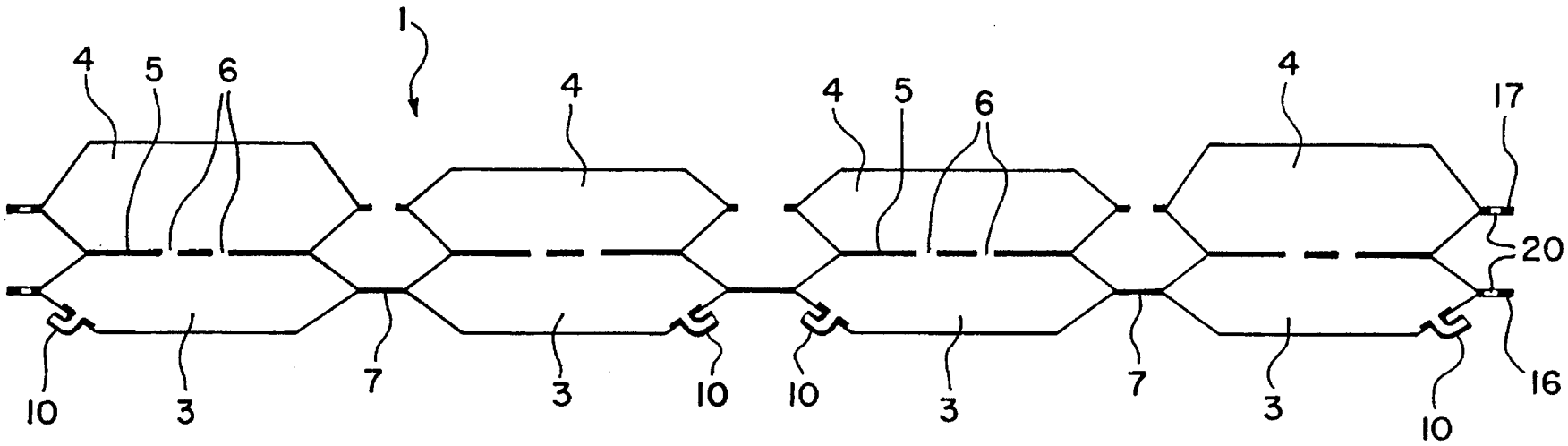
FIG. 9 is a diagrammatic transverse cross-section through a mattress in accordance with another embodiment of the present invention.

In another preferred embodiment as seen in FIG. 9, each support element 1 has an even number of double chambers or inflatable members 2, connected with one another in pairs by fillet 7, and the mattress 8 formed of a plurality of support elements 1 is inclined slightly V-shape inwardly from both longitudinal sides toward longitudinal axis 9 of mattress 8 formed by the fillets 7 located in the middle of support elements 1 to form a slightly V-shaped endview. For example, each support element of the mattress can have four inflatable sections with two inflatable sections located on each side of a central fillet, and each of the outer inflatable sections having a larger vertical height as they are spaced from the central fillet. Of course, each inflatable section includes top and bottom hollow bodies connected to adjacent inflatable sections in substantially the same manner as seen in FIGS. 1–7.

Support elements 1 of mattress 8 are preferably manufactured of a solid, expandable, flexible material. Particularly satisfactory and therefore preferable results are obtained when support elements 1 are selected from a group of a foil material consisting of polyethylene, polyvinylchloride or vulcanized natural or synthetic rubber.

While several embodiments have been chosen to illustrate and describe the present invention, it will be understood by those skilled in the art that various changes and modifications can be made herein without departing from the scope of the invention as defined in the appended claims.

What is claimed is:

1. A mattress for recumbent prophylaxis, comprising:

a plurality of inflatable support elements arranged in sequence one behind another, with each of said support elements including at least two air-inflatable sections connected together by a fillet, said support elements being detachably connected together and arranged transverse to the longitudinal axis of said mattress, so that at least two rows of said air-inflatable sections are formed in sequence one behind another to form at least first and second non-communicating chamber systems acted upon with air via an air pump assembly, each of said air-inflatable sections includes a bottom hollow body and a top hollow body connected with and overlying said bottom hollow body, said bottom and top hollow bodies being joined by a partition wall with at least one opening therein to fluidly interconnect said bottom and top hollow bodies, and adjacent said bottom hollow bodies of the same said support element being connected together along one of their sides by said fillet, while corresponding adjacent sides of said top hollow bodies of the same said support element are not connected with one another, and said fillets of said support elements being sequentially arranged relative to one another and parallel to the longitudinal axis of said mattress, and each of said air-inflatable sections being connected through a tubing system to said air pump assembly in such a manner that said at least first and second non-communicating chamber systems can be alternately inflated and deflated with air.

2. A mattress according to claim 1, wherein said air-inflatable sections of each of said support elements are arranged symmetrically around said fillet.

3. A mattress according to claim 2, wherein said tubing system includes first tubes connected to all of said air-inflatable sections of said support elements forming said first chamber system, and second tubes connected to all of the air-inflatable sections of said support elements forming said second chamber system which are not communicating with said first chamber system.

4. A mattress according to claim 3, wherein said first tubes includes first even-numbered tubes connected with said air-inflatable sections of each even-numbered ones of said support elements and first odd-numbered tubes connected with said air-inflatable sections of each odd-numbered ones of said support elements, and said second tubes includes second even-numbered tubes connected with said air-inflatable sections of each even-numbered ones of said support elements and second odd-numbered tubes connected with said air-inflatable sections of each of odd-numbered ones of said support elements.

5. A mattress according to claim 1, wherein each of said bottom hollow bodies of said support elements has an outside end which is detachably connected with another of said outside ends of said bottom hollow bodies through butt straps with press-fasteners in openings.

6. A mattress according to claim 1, wherein each of said top hollow bodies of said support elements has an outside end which is detachably connected with another of said outside ends of said top hollow bodies through butt straps with fasteners located in openings.

7. A mattress according to claim 1, wherein said partition wall has at least two openings connecting said top hollow bodies with said bottom hollow bodies.

8. A mattress according to claim 1, wherein said top hollow bodies of said air-inflatable sections of said support elements has a greater volume than said bottom hollow bodies such that in their inflated state their longitudinal side edges extend outwardly relative to longitudinal side edges of said bottom hollow bodies to cause two adjacent said top bodies to overlap one another at their longitudinal side edges.

9. A mattress according to claim 1, wherein said bottom hollow bodies and said top hollow bodies are substantially flat in their non-inflated state so as to form an extended rectangle having a pair of transverse end edges and opposite longitudinal side edges which are curved slightly outwardly at their ends, so that said end edges are longer than a distance measured between said longitudinal side edges at the center of said extended rectangle.

10. A mattress according to claim 9, wherein each of said bottom hollow bodies has a butt strap on one said transverse end edge and said fillet on its other said transverse end edge, which connect directly to said transverse end edge of an adjacent said bottom hollow body on the same said support element so that said fillet connects said bottom hollow bodies of the same said support element together.

11. A mattress according to claim 10, wherein each of said top hollow bodies has a butt strap on both transverse end edges.

12. A mattress according to claim 10, wherein each of said butt straps and said fillet have openings with fasteners therein.

13. A mattress according to claim 1, wherein each of said partition walls connecting said top hollow bodies with said bottom hollow bodies are formed by a trapezoidally shaped weld seam having its broader side arranged on the side of said partition wall closer to said fillet.

14. A mattress according to claim 1, wherein each of said support elements has additional air-inflatable sections connected by fillets with the vertical height of each of said air-inflatable sections being slightly larger than an adjacent said air-inflated section as said air-inflatable sections are spaced from the longitudinal axis of said mattress so that each of said support elements are inclined downwardly, from both longitudinal sides of said mattress toward the longitudinal axis of said mattress formed by said fillets located in along the longitudinal axis of said mattress.

15. A mattress according to claim 1, wherein said support elements are constructed of a material selected from the group consisting of polyethylene, polyvinylchloride, vulcanized natural or synthetic rubber.

* * * * *